US008383992B2

(12) United States Patent
Wang et al.

(10) Patent No.: US 8,383,992 B2
(45) Date of Patent: Feb. 26, 2013

(54) NTC/PTC HEATING PAD

(75) Inventors: Zhijing Wang, Clifton Park, NJ (US); Rumao Zhong, Lianjiang (CN); Hechuang Duan, Shenzhen (CN)

(73) Assignee: Kaz USA, Inc., Southborough, MA (US)

( * ) Notice: Subject to any disclaimer, the term of this patent is extended or adjusted under 35 U.S.C. 154(b) by 141 days.

(21) Appl. No.: 12/764,698

(22) Filed: Apr. 21, 2010

(65) Prior Publication Data

US 2011/0259872 A1 Oct. 27, 2011

(51) Int. Cl.
*H05B 1/02* (2006.01)

(52) U.S. Cl. ..... 219/492; 219/490; 219/494; 219/528; 210/721

(58) Field of Classification Search ..... 219/490, 219/492, 494, 528; 210/721
See application file for complete search history.

(56) References Cited

U.S. PATENT DOCUMENTS

2006/0186113 A1* 8/2006 Daniels et al. ..... 219/549
2008/0251509 A1* 10/2008 Robst ..... 219/488

* cited by examiner

*Primary Examiner* — Hoai V Ho
(74) *Attorney, Agent, or Firm* — Stroock & Stroock & Lavan LLP

(57) ABSTRACT

A controllable heating pad, having a heating conductor embedded in the heating pad, a sensing conductor embedded in the heating pad, a resistive material providing a distributed electrical path between the heating conductor and the sensing conductor, a first current sensor to sense a current in the heating conductor and a second current sensor to sense a current in the sensing conductor. A method of controlling a temperature of a heating pad, including the steps of: warming the heating pad to at least a first predetermined temperature by use of an adjustable on/off signal to the controllable switch, measuring currents through an NTC material or a combination of a PTC material and an NTC material; and maintaining a temperature of the heating pad to within a predetermined temperature range by use of the adjustable on/off signal to the controllable switch.

25 Claims, 15 Drawing Sheets

PRIOR ART

NTC/PTC HEATING PAD

BACKGROUND OF THE INVENTION

Heating pads and electric blankets are devices used to keep an object warmer than a surrounding temperature. For instance, they may be used to keep a person warm in a bed, or to warm a limb (e.g., an electric mitten), an animal (e.g., an electric pet blanket), an object (e.g., a pipe heater to thaw a pipe or prevent a pipe from freezing), etc. Heating pads and electric blankets in general will be referred herein as "heating pads," unless the circumstances clearly indicate otherwise. Additional layers of insulation may be used with a heating pad, such as an outer layer of insulation to lessen heat loss, or an inner partially-insulative layer to lessen a risk from a hot spot in the heating pad excessively heating an adjacent portion of the object. The additional layers of insulation may be included with the heating pad, or may be external to the heating pad (e.g., an ordinary bed blanket, comforter, or the like), spread over at least a portion of the heating pad.

Electric heating pads and blankets have heating cables that include electrical conductor(s) or wire(s) as a heating element. A conventional heating cable has one heating conductor or wire. More advanced heating cables could have more conductors which could be used as heating wires or signal sensing wires. The electrical conductors commonly are wound in a helical shape along the length of the heating cable, in order to increase the length of the conductors per unit length of the heating cable, and to provide more even heating circumferentially around the heating cable. However, other configurations of one or more of the electrical conductors may be used.

For a cable with multiple helical wound conductors, the conductors are disposed substantially coaxially along the length of the heating cable. The inner conductor can be wound around a dielectric core which may also be used to produce a desired amount of stiffness or flexibility to the cable. A sheath of a resistive material used as a separation layer is disposed around the inner conductor, and the outer conductor is wound around the separation layer. A thermally conductive outer sheath is disposed around the outer conductor to protect the heating cable while permitting heat to pass to other portions of the heating pad. For cables that use one or multiple conductors for signal sensing, the outer conductor is normally used as a heating element, but the disclosure is not limited in this regard. Electricity passes through the heating element, and the inner conductor is used as a sensing wire.

The power dissipated in the electrical conductor varies with the resistance of the electrical conductor, as well as the current (or voltage) through the electrical conductor. The electrical conductors are commonly made from a material that has a positive temperature coefficient ("PTC") characteristic, in which the resistance of the wire increases with an increasing temperature over a temperature range of interest.

The heat produced by the electrical conductors also will increase the temperature of the resistive material, producing a change in resistance of the separation layer with a change in its temperature. The separation layer may exhibit a negative temperature coefficient ("NTC") characteristic in which the resistance of the separation layer decreases as its temperature increases over a temperature range of interest.

Temperature control methods known in the art for heating pads and electric blankets include using a conductor or wire that provides a feedback signal to a control for monitoring temperature and detecting local hot spots. A conductor is coupled to a control circuit, and the circuit is designed to provide a phase change (i.e., a phase shift) with a change in the temperature of the wire. This phase shift is used as an indicator of the temperature of the wire. Another control method known in the art provides hot spot detection by using an NTC resistive material. Limited control can be accomplished by detection of a low-resistance path at a hot spot between heating and sensing wires. When the resistance is lower than a pre-set threshold, the circuit will shut down power to prevent over heating.

A drawback of the conventional approaches is that the precision of the temperature control is limited by the sensitivity of the temperature-sensing material or the method of processing feedback provided from the temperature-sensing material. The sensitivity may be low, and furthermore the sensitivity may vary over at least a portion of the temperature range of interest. Over at least a portion of the temperature range of interest, the sensitivity may not be adequate to provide a desired accuracy of temperature control. Furthermore, known control algorithms may be susceptible to degraded accuracy under a variety of conditions, such as the heating pad being partially covered, uncovered, folded over, etc.

SUMMARY OF THE INVENTION

Embodiments of the invention disclosed herein use feedback from an NTC signal, or from both PTC and NTC signals, in order to provide positive control of the temperature of the heating pad. These embodiments of the invention provide alternative methods to control heating pad temperature, under a variety of conditions such as covered, uncovered, folded over, etc The more precise, positive control of heat generation at or near an over-heated condition of the heating pad allows for incorporation of additional safety controls, and can allow for the shut down of power to the heating pad before the heating pad becomes over heated.

One or more embodiments of the invention is usable as a controllable heating pad, the controllable heating pad including a heating conductor embedded in the heating pad, a sensing conductor embedded in the heating pad, a resistive material providing a distributed electrical path between the heating conductor and the sensing conductor, a first current sensor to sense a current in the heating conductor, and a second current sensor to sense a current in the sensing conductor.

One or more embodiments of the invention is usable as a controllable heating pad system, the controllable heating pad system including: a heating conductor embedded in the heating pad, the heating conductor formed from a positive temperature coefficient (PTC) material; a sensing conductor embedded in the heating pad; a resistive material separating the heating conductor and the sensing conductor, the resistive material providing a distributed electrical path from the heating conductor to the sensing conductor, the resistive material formed from a negative temperature coefficient (NTC) material; a first current sensor in series with the heating conductor; a second current sensor in series with the sensing conductor; and a controller to control a current in the heating conductor based on an input from the first current sensor and an input from the second current sensor, wherein the heating conductor, the sensing conductor, and the resistive material are at least partially enclosed within a heat-transmissive sheath.

One or more embodiments of the invention is usable as a method of controlling a temperature of a heating pad, the heating pad having an embedded heating conductor, an embedded sensing conductor, an embedded resistive material that separates the heating conductor and the sensing conductor, and wherein a controllable switch is in series with the embedded heating conductor, the method including the steps of warming the heating pad to at least a first predetermined temperature by use of an adjustable on/off signal to the controllable switch, measuring currents through a PTC material and an NTC material, in order to determine a temperature of the heating pad, and maintaining a temperature of the heating pad to within a predetermined temperature range by use of the adjustable on/off signal to the controllable switch.

One or more embodiments of the invention is usable as a circuit to monitor a controllable heating pad, the heating pad having an embedded heating conductor connecting a source voltage to a reference potential, an embedded sensing conductor connected to the reference potential, an embedded resistive material that provides a distributed electrical path between the heating conductor and the sensing conductor, and a controllable switch in series with the embedded heating conductor, the circuit including: a first current sensor in series with the embedded heating conductor, the first current sensor connected to the embedded heating conductor at an end of the embedded heating conductor; and a second current sensor in series with the embedded sensing conductor, the second current sensor connected to the embedded sensing conductor at an end of the embedded sensing conductor, wherein a current sensed by the first current sensor is a predetermined function of the temperature of the embedded heating conductor, and a current sensed by the second current sensor is a predetermined function of the temperature of the embedded sensing conductor.

One or more embodiments of the invention is usable as a circuit to monitor a controllable heating pad, the heating pad having an embedded heating conductor connecting a source voltage to a reference potential, an embedded sensing conductor, an embedded resistive material that provides a distributed electrical path between the heating conductor and the sensing conductor, and wherein a controllable switch is in series with the embedded heating conductor, the circuit including: a first current sensor in series with the embedded heating conductor, the first current sensor having a first port connected to the embedded heating conductor at an end of the embedded heating conductor, and a second port connected to the reference potential; a first resistor having a first port connected to a supply voltage, and a second port connected to a first end of the embedded resistive material; an electrical connection from a second end of the embedded sensing conductor to the first port of the first current sensor, the second end of the embedded sensing conductor at an opposite end from the first end of the embedded sensing conductor; a second current sensor having a first port connected to the first end of the embedded resistive material, and a second port connected to the reference potential.

Advantages of embodiments of the invention further include use of a simple control method, thereby allowing for a low-cost design. The control method may achieve a similar or slightly faster warm-up time than is generally known in the art. The control method can be implemented using conventional, lower-cost wiring, thereby providing for a low-cost design. The control method may also detect fault conditions in the heating pad more quickly than the conventional art, by the detection of an anomalous pattern of NTC resistance, or an anomalous combination of NTC and PTC resistances, thereby permitting the heating pad to be shut down before the fault conditions can cause overheating.

Without intending limitation unless explicitly stated, the term "heating pad" is used herein to refer to any kind of powered covering or electric blanket which is used to provide warmth.

BRIEF DESCRIPTION OF THE DRAWINGS

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

DETAILED DESCRIPTION OF INVENTION

Figure 1:
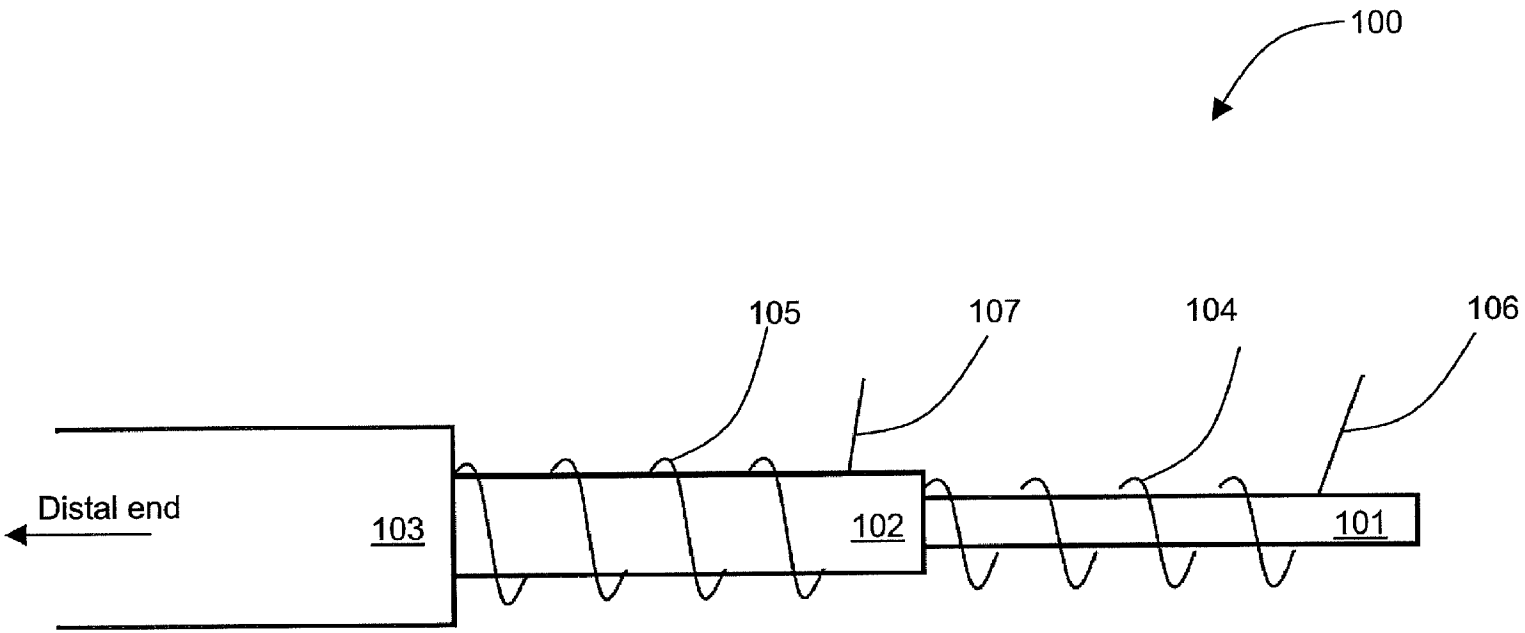
FIG. 1 is a cutaway view of a heating pad cable known in the art.

Referring now to FIG. 1, there is shown a cutaway view of a portion of a heating pad cable 100, as used in a heating pad (not illustrated), according to a technique known in the background art. A core 101 provides a desired amount of stiffness or flexibility to the heating pad cable 100. An inner conductor 104 is wound around core 101, for instance in a helical shape. A sheath of a resistive material 102 is disposed around the inner conductor 104, and an outer conductor 105 is wound around the sheath of resistive material 102. A thermally conductive outer sheath 103 is disposed around the outer conductor 105 to protect the heating cable while allowing heat to pass efficiently to the rest of the heating pad Inner conductor 104, outer conductor 105, sheath of resistive material 102 and outer sheath 103 are disposed substantially coaxially along the length of the heating pad cable 100.

The inner conductor 104 may be a PTC conductor normally used as a sensing wire, and the outer conductor 105 is a PTC heating conductor. Without limitation in this sense, the disclosure herein will refer to the inner conductor 104 as a sensing wire, and the outer conductor 105 as a heating wire.

The helical shape of the conductors 104, 105 along the length of the heating pad cable 100 increases the length of the electrical conductors 104, 105 per unit length of the heating pad cable 100 and provides more uniform heating circumferentially around the heating pad cable 100. However, other configurations of one or both of the electrical conductors 104, 105 may be used, for instance a braided conductor. An electrical path from the conductor 105 to the conductor 104 passes through the NTC resistive material 102 along a substantial length of the heating cable 100, preferably over the entire length of the heating cable 100. Respective proximal ends 106, 107 of the inner and outer conductors 104, 105 are electrically connected to a control unit which includes the control electronics, a user interface, and an interface to a power source. The distal end (not shown) of the heating wire outer electrical conductor 105 returns to the control unit and/or power source after looping through the heating pad.

Electrical resistance of the electrical conductor 105 causes electric current from an external power source to be converted into heat. The heat is transferred by conduction to other portions of the heating pad. When the external power source is disconnected, the heating pad cools toward equilibrium with the ambient temperature. Conductor 105 (the heating wire) may be configured to promote generation of heat, for instance by use of a wire having less resistance per unit length, e.g., a larger gauge wire.

Figure 2:
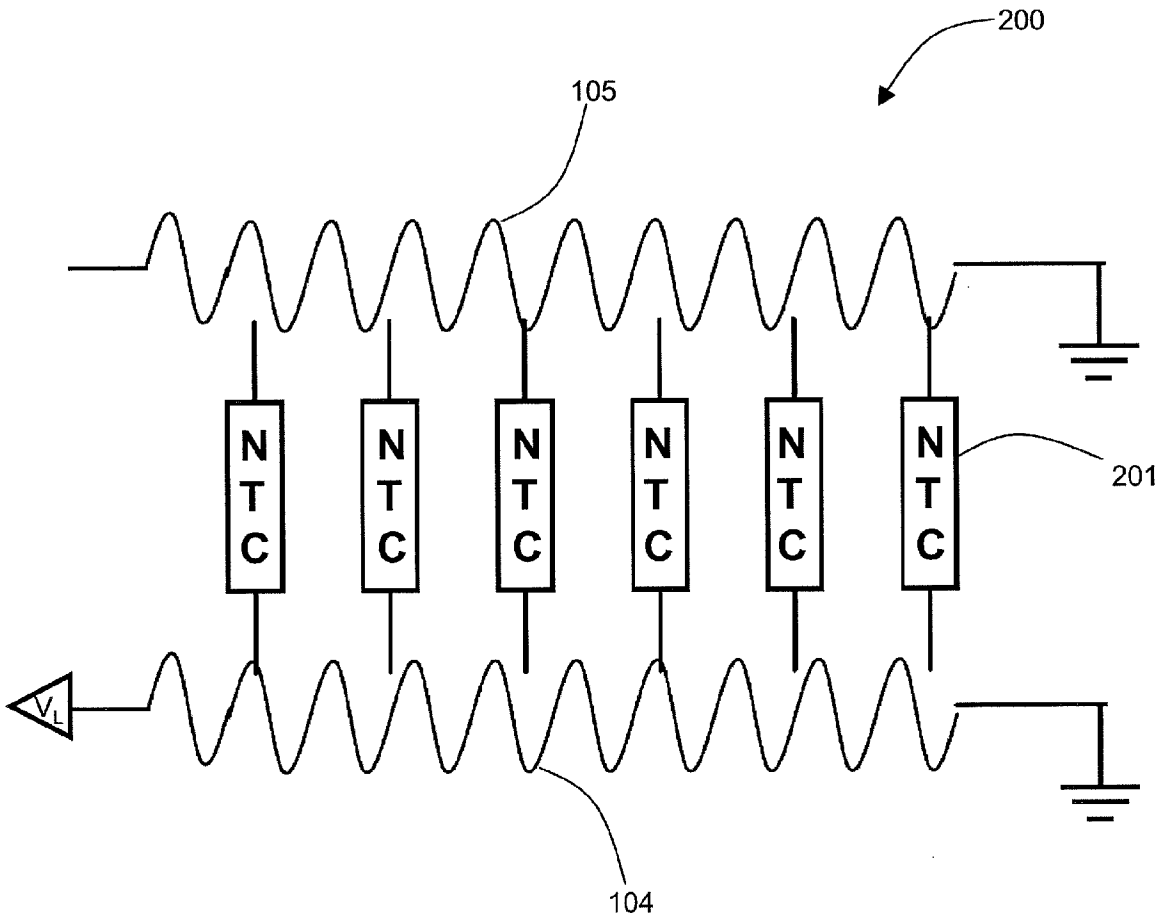
FIG. 2 is a simplified electrical block diagram of a heating cable model usable in embodiments of the present invention.

Referring now to FIG. 2, there is shown a simplified electrical block diagram 200. Electric current flows through the outer conductor 105 and raises the temperature of conductor 105 by resistive dissipation of energy. A very small portion of the electrical current from conductor 105 is diverted to inner conductor 104 through the resistive material 102, which acts as a distributed resistance (NTC resistance) between electrical conductors 104, 105. The amount of current diverted is a function of the resistance of separation layer 102, which in turn is a function of the temperature of resistive material 102. The distributed resistance is represented in electrical block diagram 200 as a plurality of resistors 201.

One or more embodiments of the present invention provide a method of control of the current in a heating pad cable, such that a temperature of the heating pad at one or more predetermined locations is controlled to within a desired temperature tolerance. The outer spiral wire 105 is made from a PTC material, and is used to produce heat by resistive dissipation of energy. Resistive material 102 is made from an NTC material. As current flows through outer electrical conductor 105 to produce heat, the temperatures of electrical conductors 104, 105 and resistive material 102 rise. The resistance of electrical conductor 105, which is made from a PTC material, rises. The resistance of resistive material 102, which is made from an NTC material, decreases. One or more embodiments of the present invention convert the resistance of the NTC material, or the combination of NTC and PTC materials, into electrical signals for use as feedback to a controller. The controller will use the feedback to control the temperature of the heating pad, by controlling the voltage and/or current delivered to the electrical conductor 105. Non-limiting examples of the control may be control of the duty cycle of the power source connected to electrical conductor 105, pulse width modulation (PWM), or an on/off control of power delivered to electrical conductor 105, the on/off control being long in cycle compared to a PWM signal, etc. The signal from the NTC or the combination of NTC/PTC will be used to control heating pad temperature.

Figure 3A:
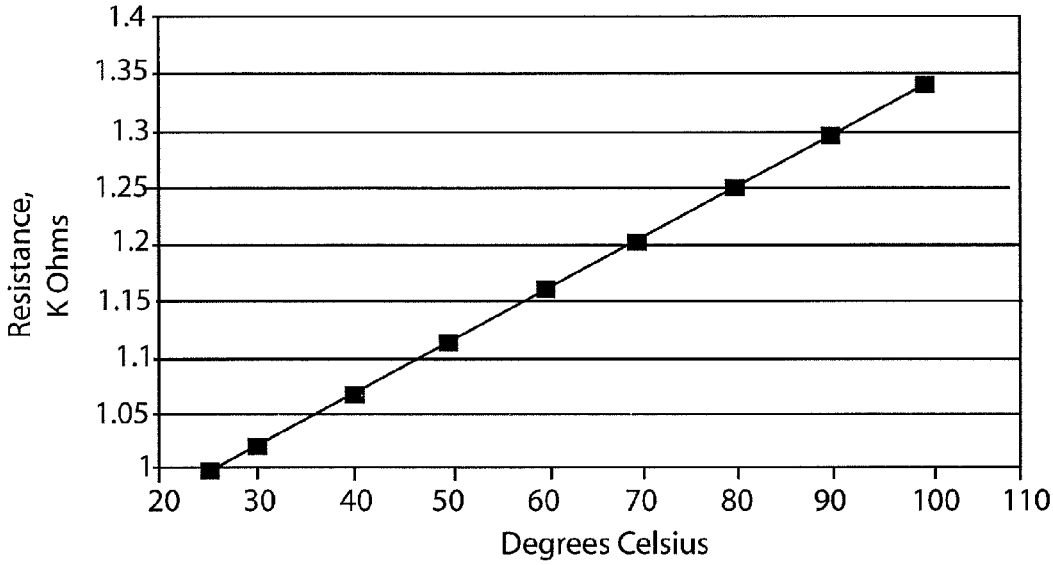
FIG. 3A is a graph of temperature versus resistance for an exemplary PTC material.
Figure 3B:
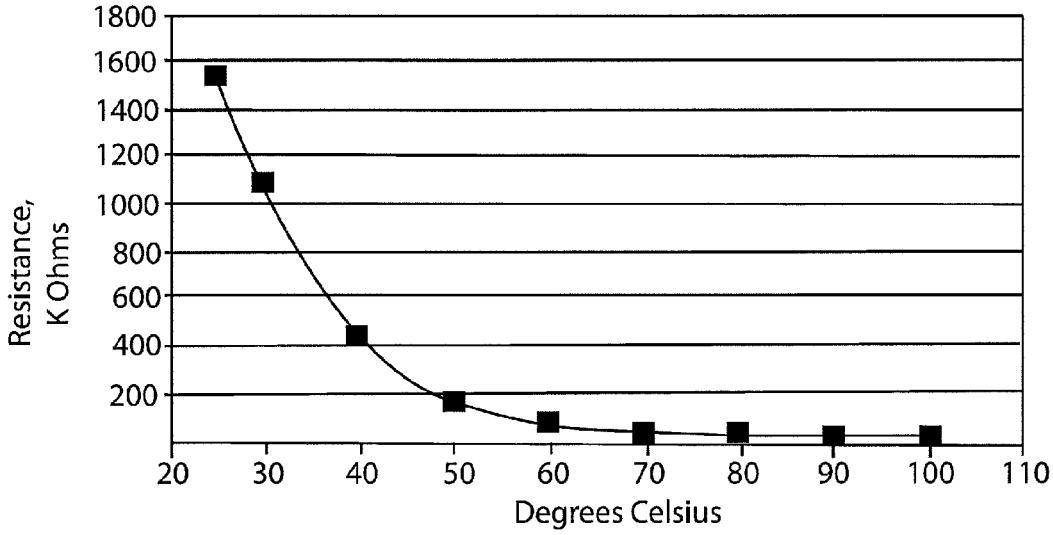
FIG. 3B is a graph of temperature versus resistance for an exemplary NTC material.

Referring now to FIGS. 3A-3B, there are shown exemplary response curves of temperature versus resistance for a PTC material (FIG. 3A) and NTC material (FIG. 3B) as known in the art. The PTC material is configured as a 10 meter length of a conductor made from PTC material. PTC conductors so configured typically exhibit a substantially linear temperature dependency of 4.5%. Power dissipated in the electrical conductor produces heat, which is transferred by conduction to produce the heat in the heating pad or electrical blanket that is felt by a user. The exemplary NTC material is configured as a resistive sheath within a 10 meter length of heating cable. NTC materials such as this typically exhibit a nonlinear temperature dependency.

Figure 4:
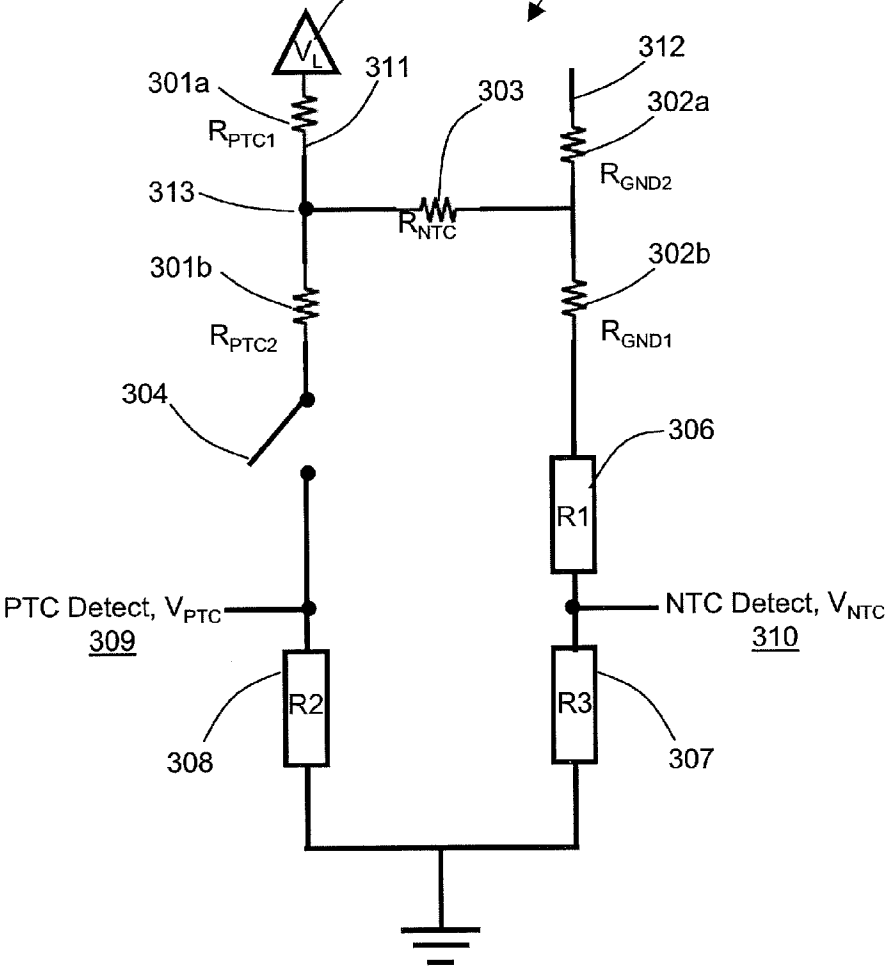
FIG. 4 is a simplified circuit diagram of a first embodiment of a circuit for detecting PTC and NTC voltages.

Referring now to FIG. 4, there is shown a simplified electrical diagram of a first embodiment of a sensing circuit 300 to sense the resistance of the combination of NTC and PTC materials, and convert the resistance into electrical signals for use as feedback to a controller. Power source 305 supplies power through switch 304 to conductor 311. The resistance of the conductor 311 is represented by lumped resistors 301*a*, 301*b* (Rpm and $R_{PTC2}$), but it should be understood that the resistance is distributed throughout the length of conductor 311. A first (PTC) sensing resistor 308 is connected in series with conductor 311, and the first sensing resistor 308 is connected to electrical ground. A sensing point 309 is used to measure the voltage across first sensing resistor 308.

An electrical path through resistive material 102 to return electrical conductor 312 is represented by a single lumped resistor 303, but it should be understood that the resistance of the resistive material 102 is distributed along substantially the full length of the resistive material 102, forming a distributed electrical connection between the conductors 311, 312, along at least a portion of the length of the resistive material 102. The resistance of the resistive material 102 at any predetermined location is dependent upon the temperature of resistive material 102 at that location. Similarly, the resistance of the return electrical conductor 312 is represented in FIG. 4 by lumped resistors 302*a*, 302*b* ($R_{GND1}$ and $R_{GND2}$), but it also should be understood that the resistance of the return electrical conductor 312 is distributed throughout the length of the return electrical conductor 312. The resistance of electrical conductors 311, 312 at any predetermined location also is dependent upon the temperature of electrical conductors 311, 312 at that location.

A current limiting resistor 306 is placed in series with the lumped resistor 302. The output of the current limiting resistor 306 is provided as an input to a second (NTC) current sensing resistor 307. A sensing point 310 is used to measure the voltage across the second current sensing resistor 307. The first and second current sensing resistors 308, 307 are connected to electrical ground.

In the embodiment of FIG. 4, the electrical conductor 311 is made from a PTC material, and the resistive material 102 is made from an NTC material. When switch 304 is closed, current flows through electrical conductor 311. The temperature of electrical conductor 311 rises due to power dissipation in lumped resistances 301*a*, 301*b*, and the temperature of the resistive material 102 rises due to heat conduction from electrical conductor 311. Consequently, the resistance of the electrical conductors 311, 312 increases, and the resistance of the sheath of resistive material 102 decreases. These changes in resistance cause more current to flow through the resistive material 102

For the purpose of analyzing circuit performance, $R_{EQV}$ represents the equivalent resistance from point 313 to ground, through parallel circuit legs $R_{PTC2}+R_2$ and $R_{NTC}+R_{GND1}+R_1+R_3$. The distributed resistance of conductor 312 is represented as equivalent lumped resistances 302*a*, 302*b*. The voltages $V_{PTC}$ at sensing point 309 and $V_{NTC}$ at sensing point 310 when switch 304 is closed are determined in accordance with equations (1) and (2). When the switch 304 is closed, the PTC voltage at sensing point 309 will be:

$$V_{PTC} \approx V_L * R_2/(R_{PTC1}+R_{PTC2}+R_2) \quad (1)$$

When the switch 304 is open, the NTC voltage at sensing point 310 will be:

$$V_{NTC} = V_L * (R_{EQV}/(R_{EQV}+R_{PTC1})) * R_3/(R_1+R_3+R_{NTC}+R_{GND1})$$

Because $R_{PTC1} << R_{NTC}$ and $R_{GND1} << R_{NTC}$, this relationship for $V_{NTC}$ can be simplified to:

$$V_{NTC} = V_L * R3/(R_{PTC1}+R_{NTC}+R_{GND1}+R_1+R_3).$$

$$\text{So: } V_{NTC} \approx V_L * R_3/(R_{NTC}+R_1+R_3). \quad (2)$$

When switch 304 is open, power is cut off to heating wire or conductor 311, and the temperature of the heating wire begins to fall. In this situation, voltages $V_{PTC}$ and $V_{NTC}$ at sensing points 309, 310 respectively are determined in accordance with equations (3) and (4):

$$V_{PTC} = 0 (\text{ground voltage}) \quad (3)$$

$$V_{NTC} = V_L * R_3/(R_1+R_3+R_{NTC}+R_{GND1}+R_{PTC1}) \quad (4)$$

It is seen from equations (1)-(4) that the voltage at sensing points 309, 310 will change based on the temperature of the heating wire. Therefore, the voltages at sensing points 309, 310 can be detected and used by a controller to control the temperature of the heating pad.

Figure 5:
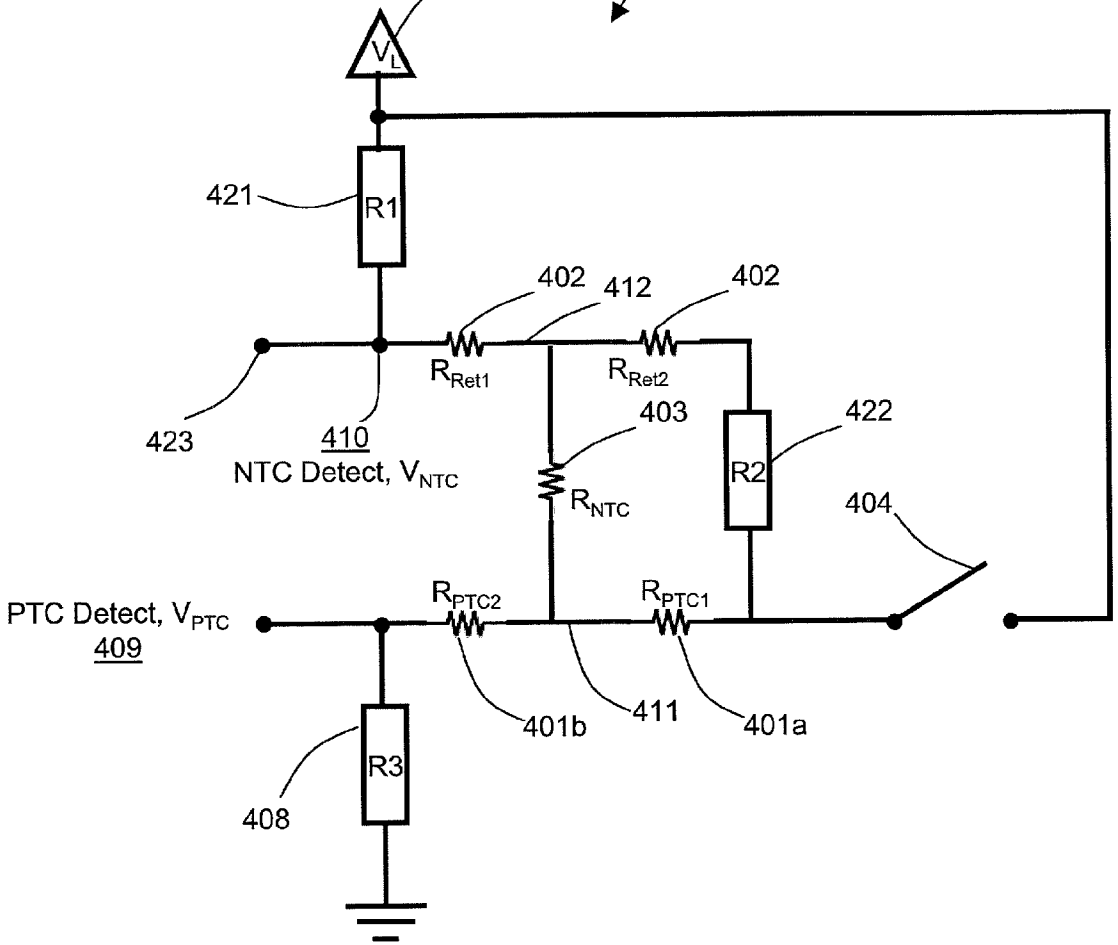
FIG. 5 is a simplified circuit diagram of a second embodiment of a circuit for detecting PTC and NTC voltages.

Referring now to FIG. 5, there is shown a simplified electrical diagram of a second embodiment of a sensing circuit 400 to sense the resistance of the combination of NTC and PTC materials, and convert the resistance into electrical signals for use as feedback to a controller. When switch 404 is in a closed position, power source 405 supplies power through switch 404 to electrical conductor 411. First (PTC) sensing resistor 408 electrically connects from conductor 411 to electrical ground. When switch 404 is in open position, current flows through resistor 421, conductor 412, resistive material 102 and resistor 422, conductor 411 and resistor 408 to ground. NTC detect sensing point 410 is used only when switch 404 is switched to an open position. The voltages at sensing point 409 when switch 404 is closed is determined in accordance with equation (5):

$$V_{PTC} = V_L * R_3/(R_3+R_{PTC1}+R_{PTC2}) \quad (5)$$

When switch 404 is in an open position, power source 405 no longer supplies power directly to electrical conductor or heating wire 411. Conductor 411 begins to cool toward room temperature, causing the lumped resistances 401*a*, 401*b* through conductor 411 to decrease. Resistive material 102 also cools, causing lumped resistance 403 to increase. The NTC voltage at sensing point 410 is determined in accordance with equation (6), wherein "||" represents the equivalent resistance of two parallel resistors:

$$V_{NTC} = V_L * (R_3+R_{RET1}+R_{PTC2}+((R_{RET2}+R_2+R_{PTC1}) \| R_{NTC}))/(R_1+R_3+R_{RET1}+R_{PTC2}+((R_{RET2}+R_2+R_{PTC1}) \| R_{NTC})) \quad (6)$$

Since $R_{NTC}$ is much larger than any of $R_{RET1}$ or $R_{RET2}$ or $R_{PTC1}$ or $R_{PTC2}$, this relationship for $V_{NTC}$ can be approximated by equation (7):

$$V_{NTC} \approx V_L * (R_{NTC} \| R_2)/(R_1+(R_{NTC} \| R_2)); \quad (7)$$

Figure 6:
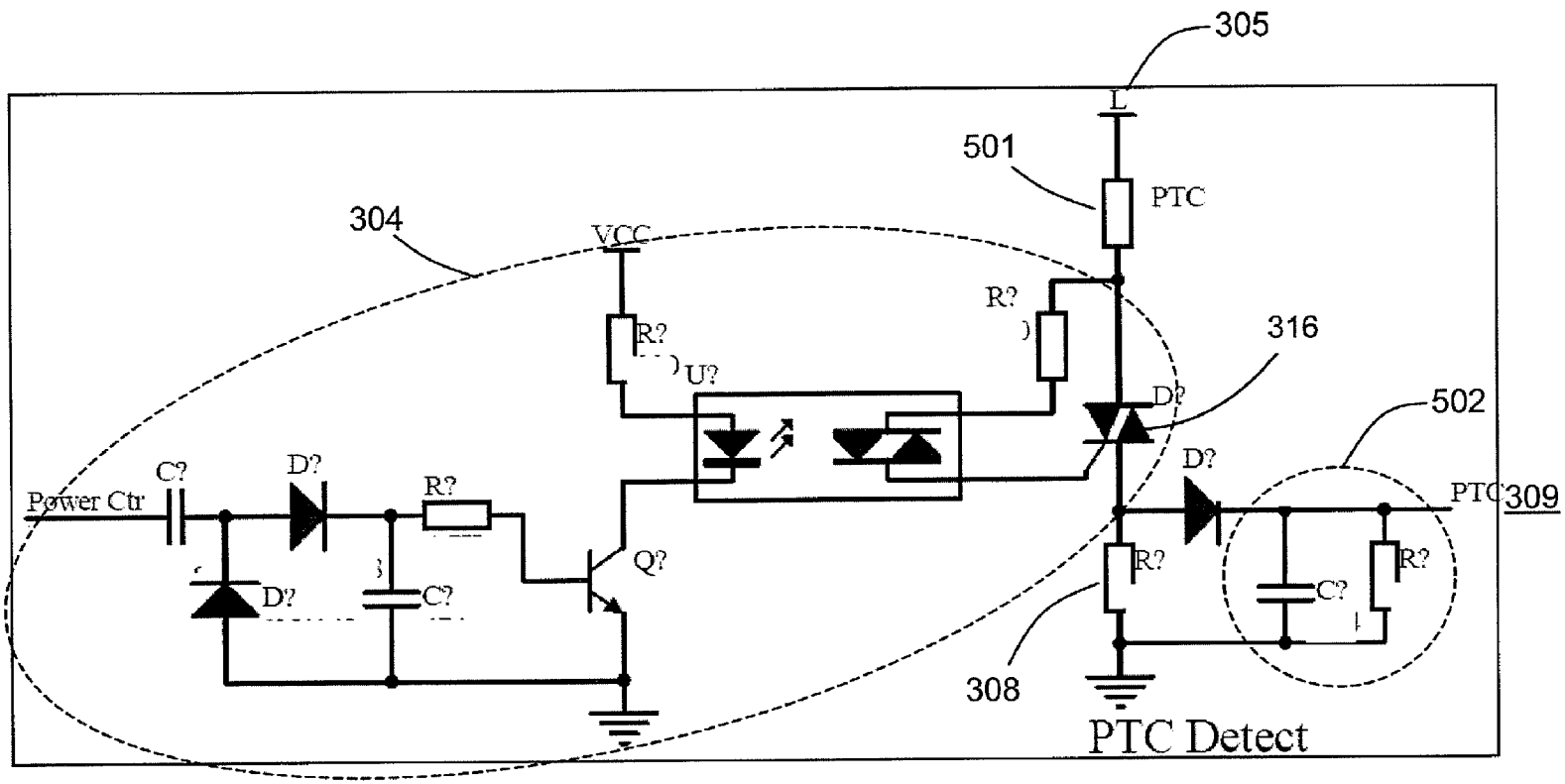
FIG. 6 is a detailed circuit diagram of a first portion of the first embodiment of a circuit detecting PTC voltage.

Referring now to FIG. 6, there is shown an exemplary circuit diagram that implements the PTC Detect portion of the simplified circuit model of FIG. 4. Supply voltage 305 provides power to PTC electrical conductor 501. Switch 304 turns on and off the power to the heating pad. Within switch 304, a triac 316 is used to open or close the heating circuit depending on the control signal. When switch 304 is closed, most current flowing through the PTC electrical conductor 501 will flow through current sensing resistor 308, and under normal temperature conditions a relatively smaller amount of current will flow from the PTC electrical conductor 501 to the sensing conductor 312 (not shown in FIG. 6) through the resistive material 102. The voltage across current sensing resistor 308 is filtered by filter 502, and the filtered voltage is provided at PTC sensing point 309. Filter 502 typically is a conventional R-C filter.

Figure 7:
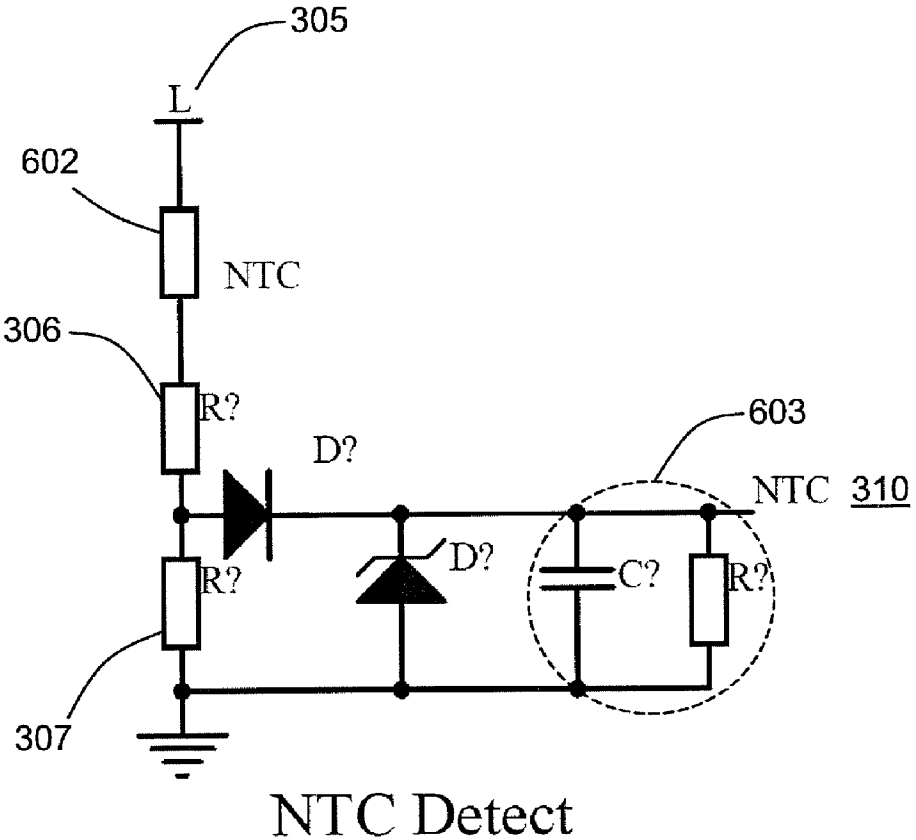
FIG. 7 is a detailed circuit diagram of a second portion of the first embodiment of a circuit detecting NTC voltage.

Referring now to FIG. 7, there is shown an exemplary circuit diagram that implements the NTC Detect portion of the simplified circuit model of FIG. 4. Supply voltage 305 provides power to NTC equivalent resistance 602, which is the resistance of the separation layer 102. Power flows through current limiting resistor 306 and current sensing resistor 307. The voltage across current sensing resistor 307 is filtered by filter 603, and the filtered voltage is provided at NTC sensing point 310. Filter 603 typically is a conventional R-C filter.

Figure 8:
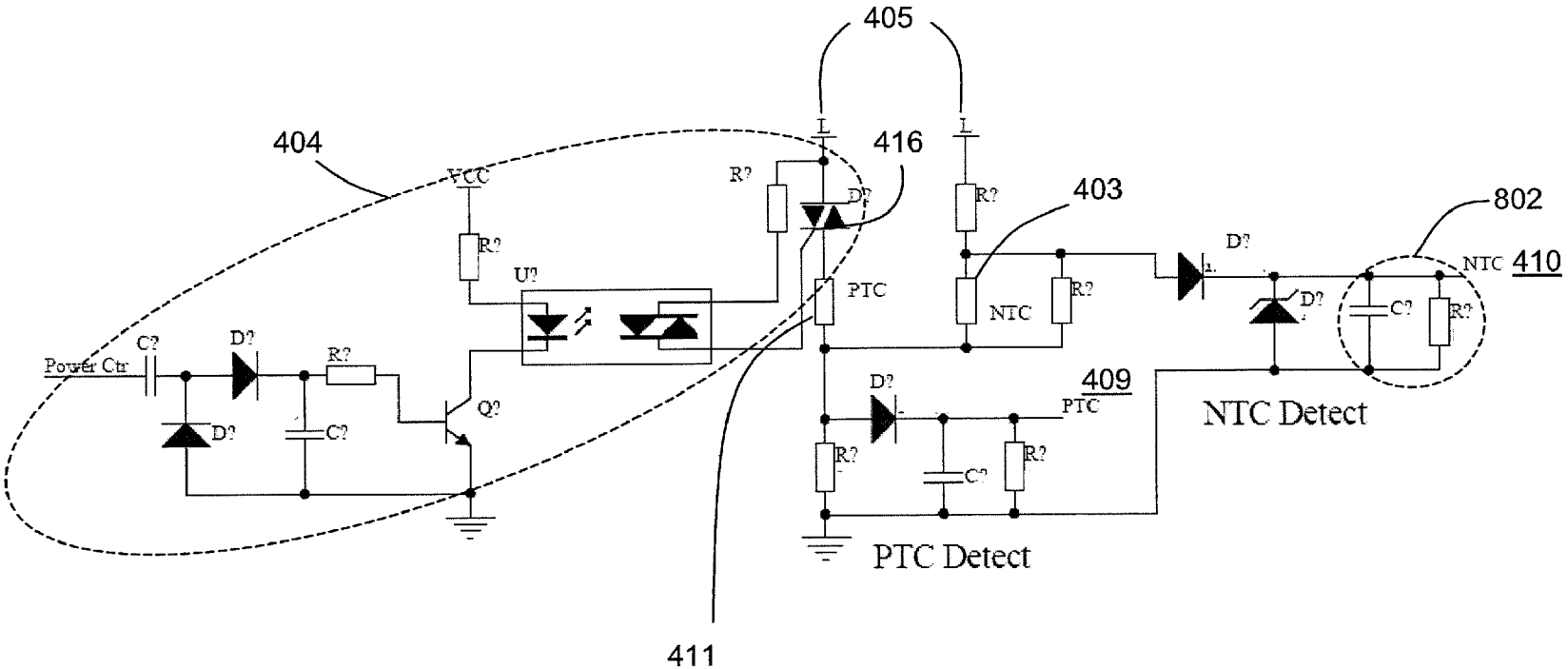
FIG. 8 is a detailed circuit diagram of the second embodiment of a circuit to detecting PTC and NTC voltages.

Referring now to FIG. 8, there is shown an exemplary circuit diagram that implements the simplified circuit model of FIG. 5. Supply voltage 405 provides power to PTC electrical conductor 411. Filter 802 provides a filtered voltage at NTC sensing point 410. Switch 404 turns on and off the power to the heating pad. Within switch 404, a triac 416 is used to open or close the heating circuit depending on the control signal. When switch 404 is closed, power flows through current sensing resistor 408, and a filtered voltage is provided at PTC sensing point 409.

Figure 9:
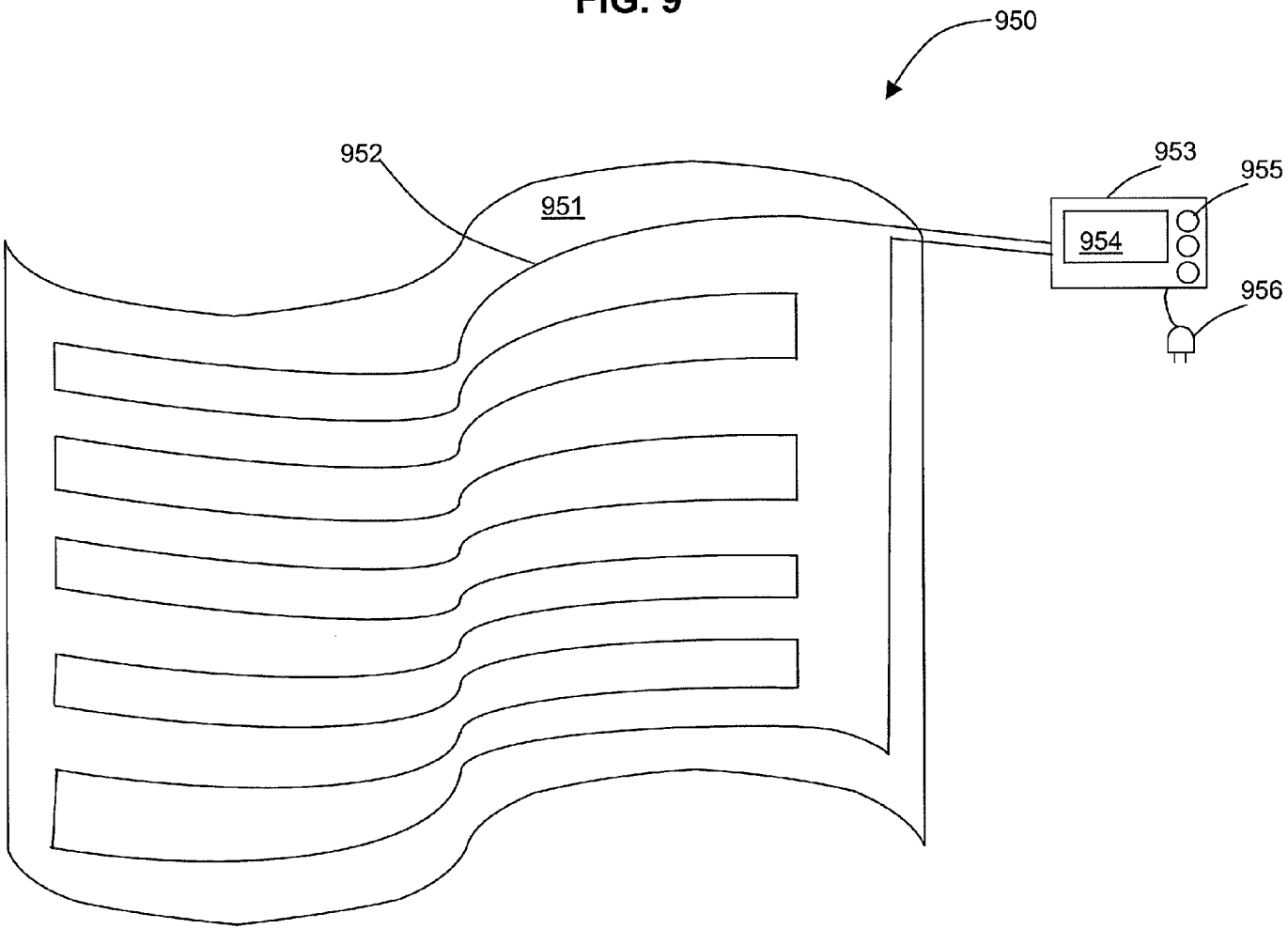
FIG. 9 is a system diagram according to an embodiment of the invention.

Referring now to FIG. 9, there is shown an exemplary heating pad system 950 including one or more embodiments of the invention. A flexible pad 951 includes an embedded heating cable 952 which is formed in a pattern that covers a substantial portion of pad 951. The pattern may depart from the pattern shown in FIG. 9. Heating cable 952 originates from, and terminates at, a control unit 953. Control unit 953 provides at least a processor to control the heating pad system, sensing electronics such as the sensing electronics of FIGS. 6-8, an auto-shutoff timer, an output interface 954 to indicate status of the heating pad system 950, one or more controls 955, and an interface 956 to an external power source. Output interface 954 may include, for instance, a display screen as shown in FIG. 9, or output interface 954 may include a set of LED status indicators.

Embodiments of the invention include a method of controlling switch 304 or 404, by use of voltages sensed at sensing points 309, 310 or 409, 410, in order to set and to maintain the temperature of the heating pad to a predetermined temperature. The method is implemented on a processor which collects voltage measurements at sensing points 309, 310 or 409, 410. The processor then uses those measurements as data inputs to a control method stored in a memory used by the processor. The memory storage of the control method may be implemented in any kind of digital storage used by processors for storage purposes. The memory storage of data used by the method or produced by the method may be implemented in any kind of dynamic or rewritable digital storage used by processors for storage purposes. The control method causes the processor to command switch 304 or 404 on and off in order to control the heating pad temperature. The control method includes at least a heating mode to warm up the heating pad from an ambient temperature, a temperature maintenance mode to keep the heating pad within a predetermined tolerance of a desired temperature, a safety mode to monitor for safe operating conditions, and a shut-down mode to turn off the heating pad in a controlled manner.

Figure 10:
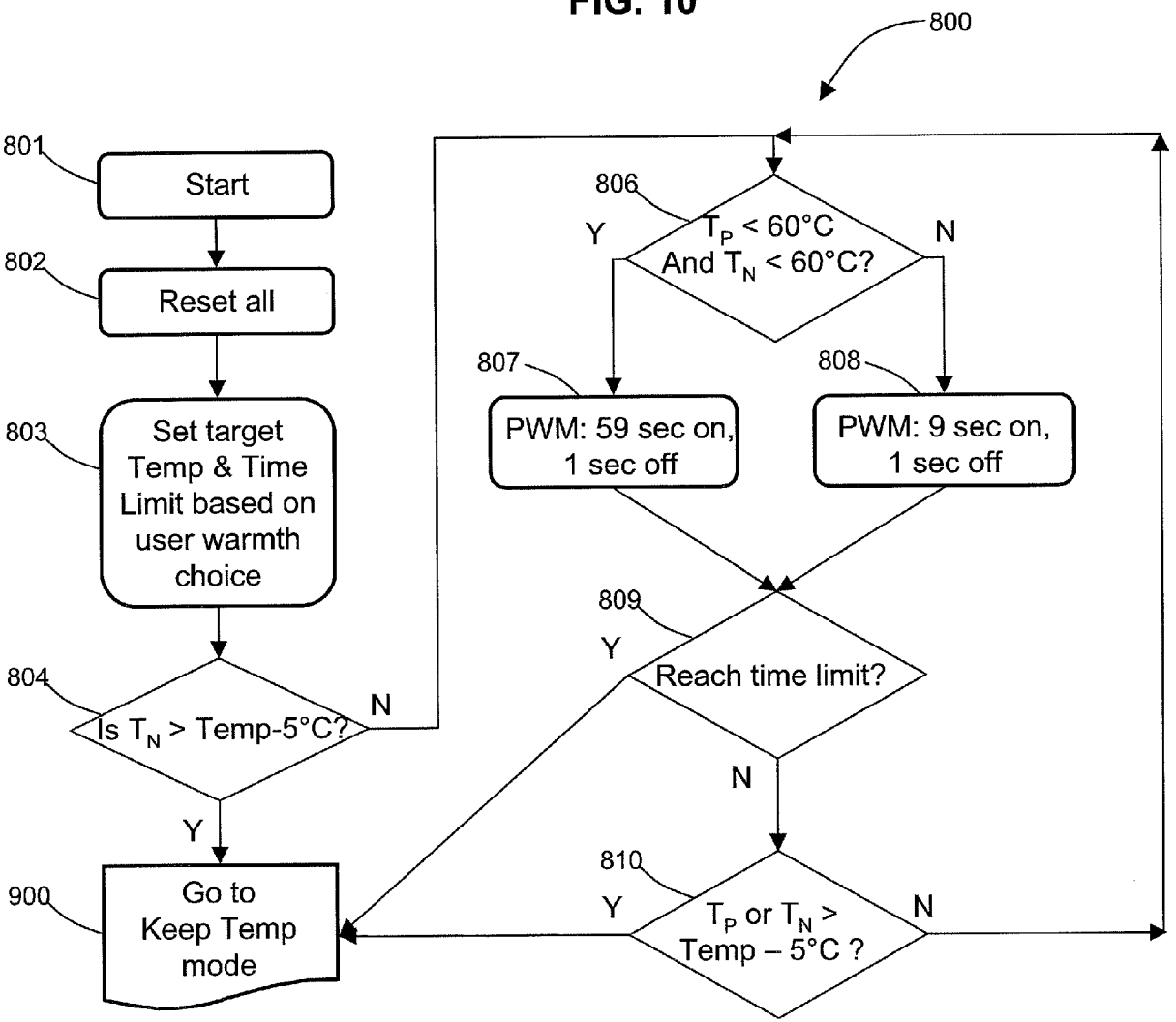
FIG. 10 is an exemplary flowchart of a first portion of a control method according to an embodiment of the invention.

Referring now to FIG. 10, there is shown an exemplary flow chart of a mode of the control algorithm, Heating Mode 800, used to control switch 304 or 404. $T_P$ refers to the temperature of the PTC material, after scaling the voltage sensed at PTC sensing points 309 or 409. $T_N$ refers to the temperature of the NTC material, after scaling the voltage sensed at NTC sensing points 310 or 410. In Heating Mode 800, the heating pad is warmed up to within a predetermined tolerance of the user's desired temperature setting. Upon turn-on and/or reset of the heating pad, the control algorithm enters Heating Mode 800 at Start block 801. Any existing limits for a target temperature may be reset at block 802. Next, in block 803 a target temperature (Temp) and time limit are assigned based on a user's choice of how warm the heating pad should become. For instance, the heating pad controls may be designed to allow a user to select one heat setting from among the choices of "Warm", "Low", "Medium" and "High". These settings may be assigned target temperatures of 55° C., 60° C., 65° C. and 70° C., respectively. Each setting has associated with it a time limit which sets, as a safety feature, a maximum amount of time that the heating pad will be turned on at the selected heat setting. In one embodiment, a time limit of 25 minutes may be used for each heat setting. In another embodiment, a longer time limit until the blanket is automatically turned off may be used for lower heat settings, because there is less risk of overheating. Other embodiments may be possible, and the invention is not limited in this regard. An elapsed time timer is started to keep track of the time that has elapsed since the heating pad was turned on.

The control algorithm of Heating Mode 800 next passes to decision block 804, to check whether the temperature $T_N$ of the NTC material is greater than a predetermined threshold. For instance, FIG. 10 illustrates a predetermined threshold that is 5° C. below the target temperature set in block 803. If the result of decision block 804 is affirmative, control passes to block 900, the Keep Temp mode. If the result of decision block 804 is negative, control passes to a loop which applies an on/off modulated signal to the heating cable.

The loop to apply an on/off modulated signal to the heating cable begins with decision block 806, in which $T_P$ and $T_N$ are tested to determine if they are below a predetermined threshold. In one embodiment the predetermined threshold is 60° C. for both $T_P$ and $T_N$. In other words, the control method should not change power mode if $T_P$ and $T_N$ both do not indicate that the temperature has reached the predetermined threshold. Other embodiments with other threshold temperatures may be possible, including unequal thresholds for $T_P$ and $T_N$, so the invention is not limited in this regard. If the result of decision block 806 is affirmative (i.e., the heating pad is not above the predetermined threshold temperature), then a modulated signal having a relatively long "on" portion is provided by block 807 to control switch 304 or 404. The relatively long "on" portion will facilitate a more rapid heating of the cable. If the result of decision block 806 is negative (i.e., the heating pad is close to the target temperature), then a modulated signal having a relatively short "on" portion is provided by block 808 to control switch 304 or 404. The relatively short "on" portion will facilitate a more gradual heating of the cable. In one embodiment, the modulated signal having a relatively long "on" portion may comprise a signal that is on for 59 seconds and off for 1 second. The modulated signal having a relatively short "on" portion may comprise a signal that is on for 9 seconds and off for 1 second. It should be understood that different ratios of on/off times, or additional ratios that are dependent upon how much $T_P$ or $T_N$ differ from the predetermined temperature threshold, may be used to provide different or additional control over the rate of heating.

At the conclusion of block 807 or block 808, a test is made in decision block 809 to determine if the elapsed time has reached the time limit set by the user in block 803. If the result of decision block 809 is positive, then control passes to block 900, the Keep Temp mode. If the result of decision block 809 is negative, control passes to decision block 810. Decision block 810 checks whether $T_P$ or $T_N$ are greater than a predetermined threshold (e.g., 5° C.) of the target temperature established in block 803, and if one or both are greater than the predetermined threshold then control is transferred to the Keep Temp Mode 900. If both $T_P$ and $T_N$ are less than the predetermined threshold, then control loops back to decision block 806 for additional heating. A more precise ability to monitor the temperature of the heating pad allows for the heating pad to be rapidly warmed more closely to the desired temperature setting, with little risk of overheating, compared to the rate of warming associated with a same risk of overheating when a less precise monitoring ability is used.

Figure 11:
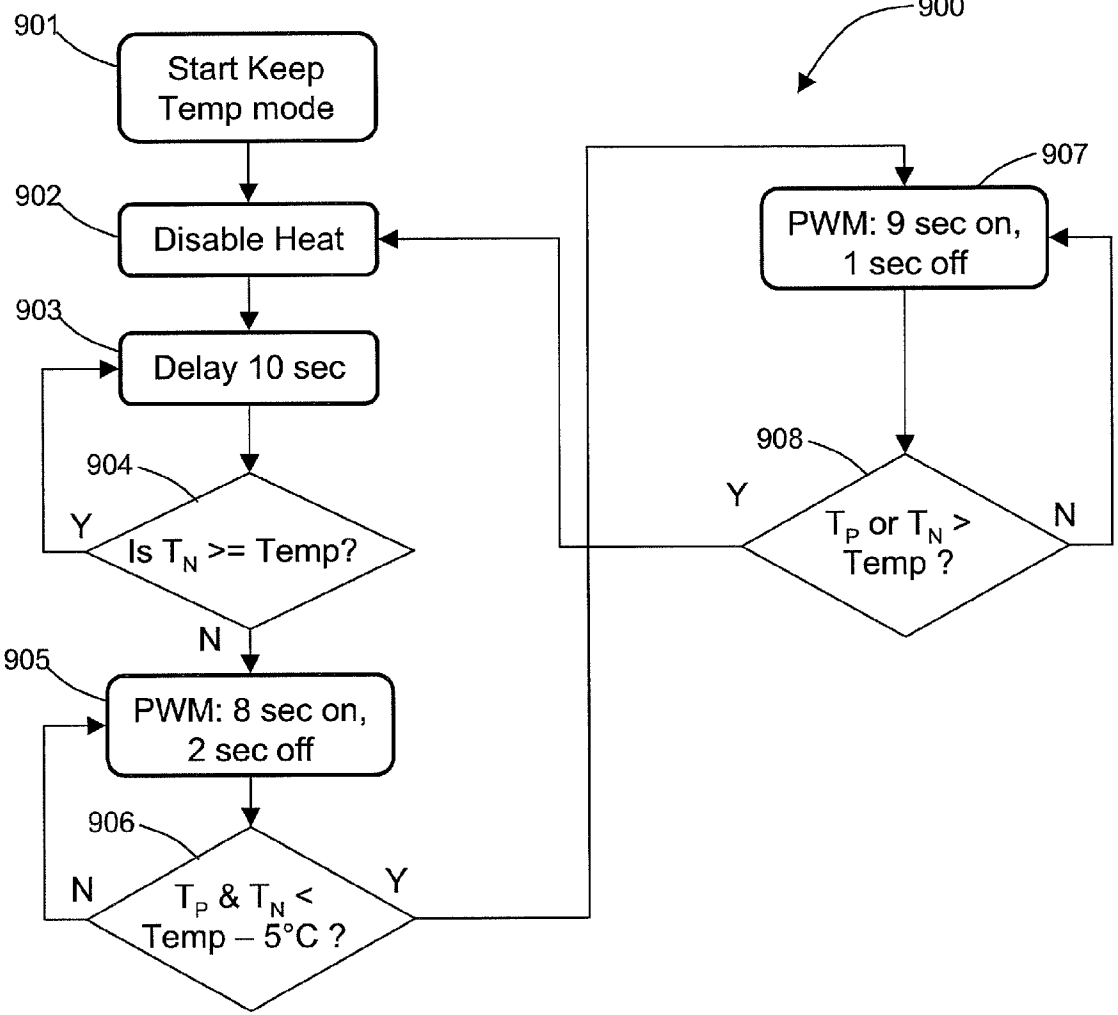
FIG. 11 is an exemplary flowchart of a second portion of a control method according to an embodiment of the invention.

Referring now to FIG. 11, there is shown an exemplary flow chart of a mode of the control algorithm, Keep Temp Mode 900, used to control switch 304 or 404. In Keep Temp Mode 900, the heating pad is kept warm to within a predetermined tolerance of the user's desired temperature setting, by selectively opening and closing switch 304 or 404 in order to successively heat the conductive element 104 and then allowing it to cool. The control algorithm enters Keep Temp Mode 900 at Start block 901. Next, the heat is disabled in block 902 by the temporary opening of switch 304 or 404, and entering wait state 903 in order to allow the heating pad to cool, as measured by the temperature $T_N$ of the NTC material. When the switch 304 or 404 is opened, the circuit detects temperature only by use of the NTC sensor. An exemplary time limit for wait state 903 is 10 seconds, but other time limits may be used, such that the heating pad is likely to cool by a relatively small amount during the wait state compared to the user's desired temperature setting.

Upon the conclusion of wait state 903, the temperature $T_N$ of the NTC material is measured, and decision block 904 determines whether temperature $T_N$ of the NTC material has cooled to a temperature less than the target temperature limit ("Temp") associated with the user's selected heat setting, as set in block 803 of FIG. 10. If $T_N$ is still greater than the target temperature limit, then delay block 903 and decision block 904 are repeated as necessary until temperature $T_N$ is less than the target temperature limit.

Once temperature $T_N$ of the NTC material has cooled below the user's selected heat setting, control exits decision block 904 and continues to a heating block 905, in which the switch 304 or 404 is turned on for a relatively shorter duty cycle than blocks 807 and 808 of Heating Mode 800. For instance, heating block 905 may provide a cycle of 8 seconds ON and 2 seconds OFF. The relatively shorter duty cycle of heating block 905 provides for a cool-down compared to the relatively longer duty cycles of heating blocks 807 and 808 that produce heating. Upon the conclusion of one cycle of heating block 905, the temperature $T_N$ of the NTC material and the temperature $T_P$ of the PTC material are both tested at decision block 906 to determine if both $T_N$ and $T_P$ have fallen to at least 5° C. below the target temperature limit. If the result of decision block 906 yields a negative result, control passes back to heating block 905. If the result of decision block 906 yields a positive result, control passes to heating block 907.

Heating block 907 provides a relatively longer duty cycle than heating block 905, for instance a cycle of 9 seconds ON and 1 second OFF. The cycle of heating block 907 is sufficient to gradually raise the temperature of the heating blanket. Upon the conclusion of one cycle of heating block 907, the temperature $T_N$ of the NTC material and the temperature $T_P$ of the PTC material are both tested at decision block 908 to determine if at least one of $T_N$ and $T_P$ have risen to become greater than the target temperature limit. If the result of decision block 908 is negative, then control passes to heating block 907 for further warming. If the result of decision block 908 is positive, then control passes back to block 902 to disable heat and perform another iteration of the Keep Temp Mode 900. Keep Temp Mode 900 may be exited upon an auto-shutoff initiated by a watchdog timer or similar, causing transition to the ShutOFF mode 1100 described below.

Figure 12:
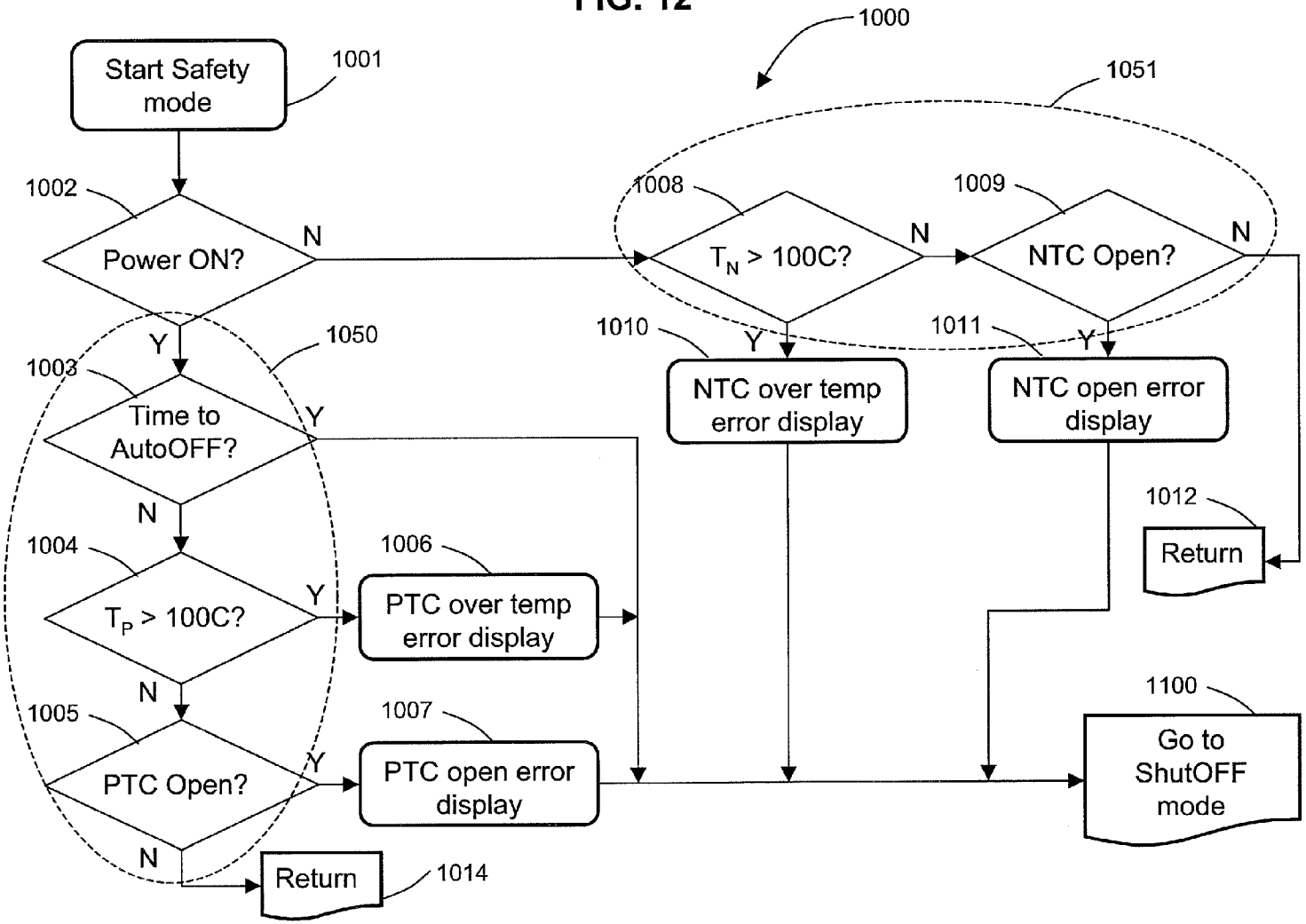
FIG. 12 is an exemplary flowchart of a third portion of a control method according to an embodiment of the invention.

Referring now to FIG. 12, there is shown an exemplary flow chart of a mode of the control algorithm, Safety Mode 1000, used to control switch 304 or 404. Safety Mode 1000 monitors for the presence of anomalous conditions, and initiates a shut down of the heating pad if one or more anomalies are detected. Safety Mode 1000 is callable from within other operating modes, or may also be callable by an interrupt-driven process in response to the detection of anomalies within the other operating modes.

The control algorithm enters Safety Mode 1000 at Start block 1001. Control first passes to the first decision block 1002, which checks whether power is turned on to the heating pad. If the response to decision block 1002 is affirmative, then control transfers to a first plurality 1050 of decision blocks. If the response to decision block 1002 is negative, then control transfers to a second plurality 1051 of decision blocks. Within the first and second pluralities 1050, 1051 of decision blocks, individual tests for anomalous conditions may be performed in any order.

In one embodiment, first plurality 1050 of decision blocks includes decision block 1003, which checks whether the auto-shutoff timer has expired. The auto-shutoff timer is a safety feature that prevents the heating pad from being turned on for more than a predetermined amount of time, thereby lessening the risk of overheating. If the response to decision block 1003 is affirmative, control passes to ShutOFF mode 1100, which is described in further detail below in connection with FIG. 13. If the response to decision block 1003 is negative, then control passes to decision block 1004, which checks whether $T_P$ is greater than a predetermined threshold, wherein $T_P$ refers to the temperature of the PTC material, calculated from scaling the voltage sensed at PTC sensing points 309 or 409. The predetermined threshold used in decision block 1004 may be approximately 100° C., but other approximate values may be used that are greater than the maximum user-selected heat setting. If the response to decision block 1004 is positive, then control passes to optional block 1006 which may provide a PTC over-temperature indication to a user, and from there control passes to ShutOFF mode 1100. If the response to decision block 1004 is negative, then control passes to decision block 1005, which checks whether one or both of the PTC electrical conductors are presenting an open circuit. If the response to decision block 1005 is positive, then control passes to optional block 1007 which may provide a PTC open indicator to the user, and from there control passes to ShutOFF mode 1100. If the response to decision block 1005 is negative, then control passes to step 1014 which returns to the operating mode which called the Safety Mode 1000.

In one embodiment, second plurality 1051 of decision blocks includes decision block 1008, which checks whether $T_N$ is greater than a predetermined threshold, wherein $T_N$ refers to the temperature of the NTC material, calculated from scaling the voltage sensed at NTC sensing points 310 or 410. The predetermined threshold used in decision block 1008 may be approximately 100° C., but other approximate values may be used that are greater than the maximum user-selected heat setting, and which are substantially the same as the predetermined threshold used in decision block 1004. If the response to decision block 1008 is positive, then control passes to optional block 1010 which may provide an NTC over-temperature indication to a user, and from there control passes to ShutOFF mode 1100. If the response to decision block 1008 is negative, then control passes to decision block 1009, which checks whether the NTC resistive material 102 is presenting an open circuit. If the response to decision block 1009 is positive, then control passes to optional block 1011 which may provide an NTC open indication to the user, and from there control passes to ShutOFF mode 1100. If the response to decision block 1009 is negative, then control passes to step 1012 which returns to the operating mode which called the Safety Mode 1000.

It should be noted that the decision blocks within each of first and second pluralities 1050 and 1051 may be performed in a different order from the order described in FIG. 12 and related text, without substantially affecting the operation of Safety mode 1000.

Figure 13:
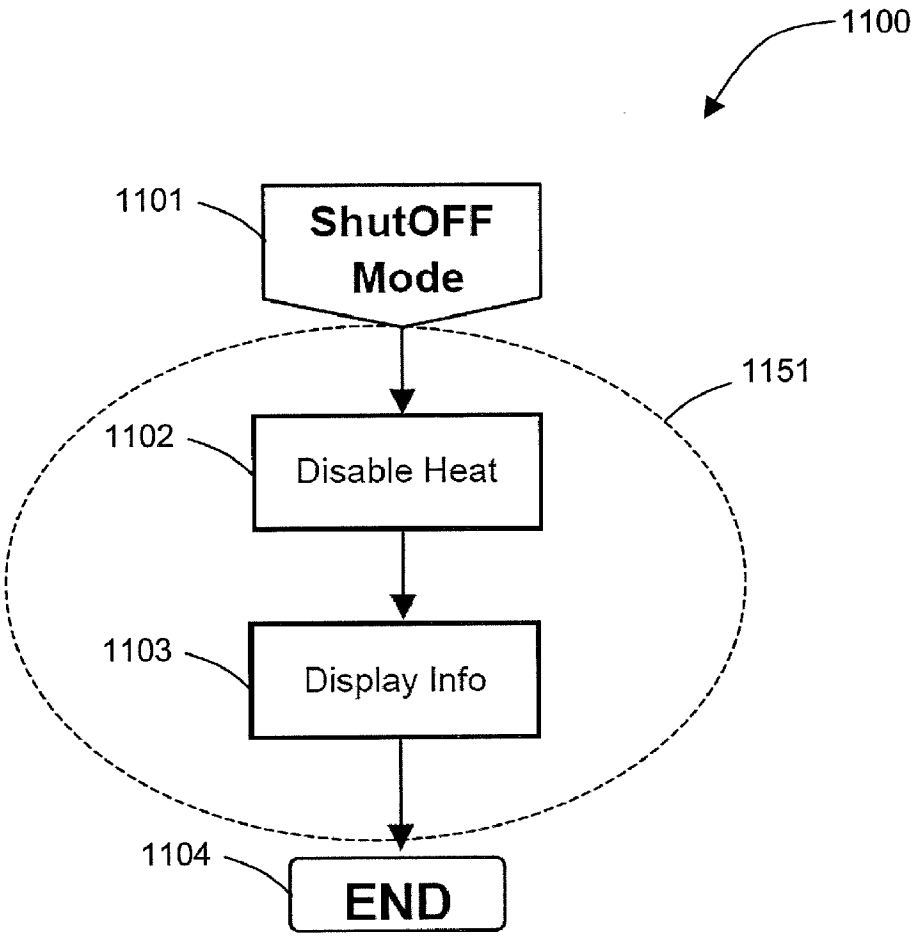
FIG. 13 is an exemplary flowchart of a fourth portion of a control method according to an embodiment of the invention.

Referring now to FIG. 13, there is shown an exemplary flow chart of a mode of the control algorithm, ShutOFF Mode 1100, used to control switch 304 or 404. ShutOFF Mode 1100 performs a shut down of the heating pad in response to either a user-initiated action (e.g., activating a switch or reset control), or in response to a calling of ShutOFF mode 1100 from within Safety mode 1000.

The control algorithm enters ShutOFF Mode 1100 at block 1101. Control passes to a plurality 1151 of blocks that perform shutdown functions. Within the plurality 1151 of blocks, individual shutdown functions may be performed in any order. In the embodiment of FIG. 13, plurality 1151 of blocks first includes a function 1102 that disables power supplied to the heating pad, e.g., by opening switch 304. Next, optional function 1103 may provide an indication to a user of information related to the shutdown, e.g., a visible display, message, LED change of state, audible or vibratory indicator, etc. Finally, the processor implementing ShutOFF Mode 1100 enters end state 1104, which is an OFF state. ShutOFF Mode is not limited to the shutdown functions shown, and may include additional functions.

Figure 14:
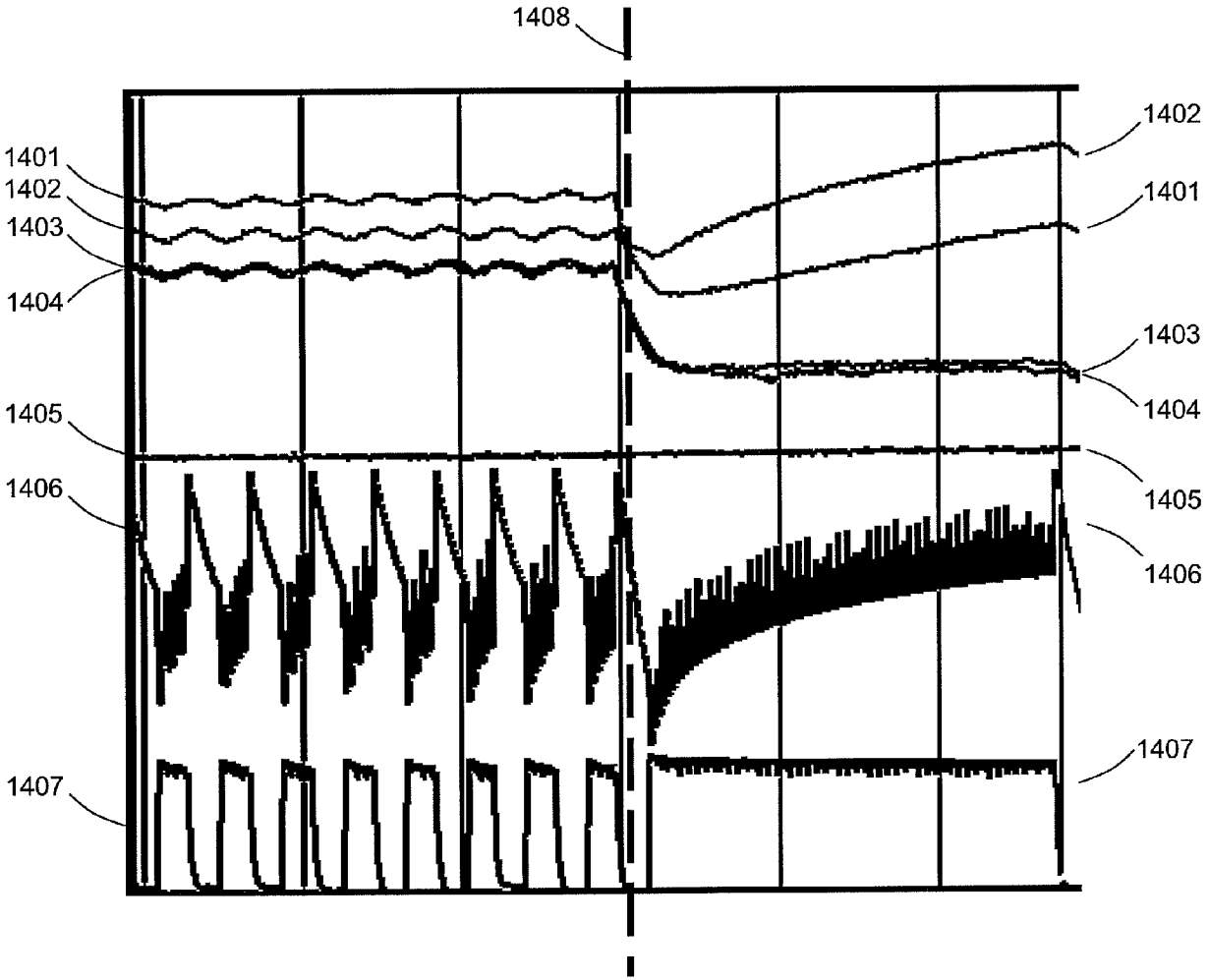
FIG. 14 is an illustration of testbed test data of a system in a full-blanket configuration, according to an embodiment of the invention.

Referring now to FIG. 14, there is shown an exemplary set of temperature steady-state measurements 1401-1407 of a prototype heating pad corresponding to one or more embodiments of the invention. The measurements 1401-1407 to the left of line 1408 of FIG. 14 are for a prototype heating pad that is in a full blanket condition, wherein the heating pad is laid out substantially without any folds, and is substantially covered in its entirety by an ordinary bed blanket, comforter, or the like. The abscissa is a time-based scale having a scale of about 5 minutes between major marks. The ordinate of measurement 1401-1407 has been adjusted in part for the sake of clarity in order to provide a substantially non-overlapping display of each measurement.

Measurements 1401-1404 represent temperatures of a heating pad in accordance with an embodiment of the present invention, measured at four different points in the heating pad. Prior to the time indicated by marker 1408, each measurement 1401-1404 has a relatively small periodic fluctuation around a respective mean value, thereby indicating that each measurement 1401-1404 of the heating pad is in a steady-state condition. Typically, a temperature spread of the mean values is approximately 10° C., depending on the locations of the heating wire and temperature sensors. Measurement 1405 is the ambient temperature of approximately 28° C.

Measurement 1406 is the NTC signal used to control the power on and off to the blanket. Note that the peaks and troughs of measurement 1406 are substantially synchronous in time with the peaks and troughs of temperature measurements 1401-1404, respectively. The synchronicity indicates that while the NTC signal of measurement 1406 is increasing, indicating that the current flow through the NTC material is increasing, the heating pad temperature is also increasing. A hotter heating pad decreases the resistance of the NTC material and produces a greater electrical current through the NTC material, as would be expected by its negative temperature coefficient.

Measurement 1407 is the power input, which has a power of approximately 40 watts peak. Input powers of approximately 40-75 watts peak (not illustrated) generally are usable for a heating pad used to warm a bed. Note that measurement 1407 illustrates alternating cycles of on, followed by off The "on" cycles are substantially synchronous in time with periods when the NTC current signal is increasing, as indicated by measurement 1406, and periods when the heating pad is heating up as indicated by measurements 1401-1404. Likewise, the "off" cycles of measurement 1407 are substantially synchronous in time with periods when the NTC current signal is decreasing, and periods when the heating pad is cooling down. Optionally, a power limit may be provided in the heater control, such that the "on" time of measurement 1407 is limited to no more than a predetermined length of time or a predetermined duty cycle.

At the time indicated by marker 1408, the heating pad was reconfigured from a full-blanket configuration into a half-blanket configuration, in which a significant portion of the heating pad (approximately half) was uncovered by the blanket. FIG. 14 shows an interim period of time after marker 1408 before the heating pad reentered a steady-state condition as described below in connection with FIG. 15. During this interim period of time, power was briefly turned off as indicated by measurement 1407, before power was turned on full-time. While power was briefly turned off, the temperature of measurements 1401-1404 dropped, some sharply. When power was turned back on as indicated by measurement 1407, the sensors associated with measurements 1403, 1404 were in an uncovered portion of the heating pad and never recovered to their full-blanket level prior to marker 1408, while the sensors associated with measurements 1401, 1402 were in a covered portion of the heating pad and recovered to temperatures similar to their temperatures in the full-blanket configuration.

Note that the NTC signal of measurement 1406 take a relatively long time to recover in the half-blanket configuration. This is because when approximately half of the pad is exposed, heat dissipation is much faster than if the whole heating pad were under a blanket in the full-blanket configuration. It will take more time for the heating pad to reach a desired temperature. Therefore the NTC signal associated with measurement 1407 recovers to a desired temperature much more slowly after marker 1408.

Figure 15:
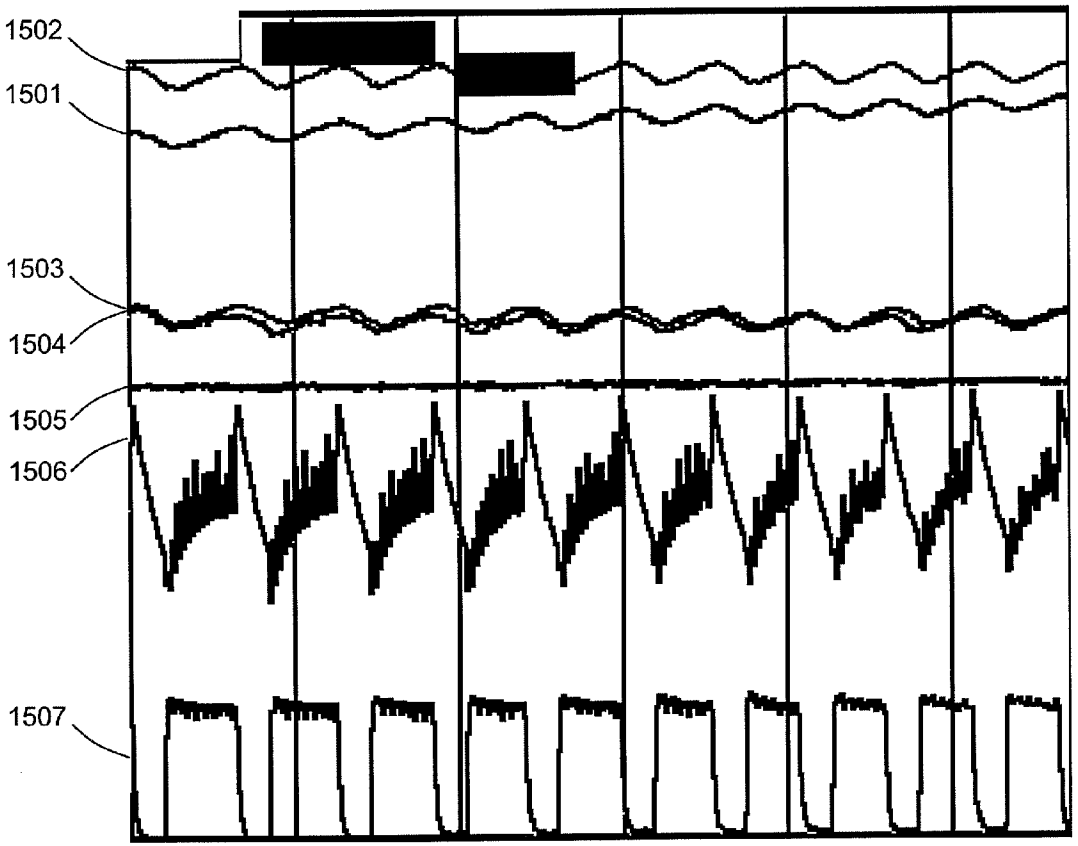
FIG. 15 is an illustration of testbed test data of a system in a half-blanket configuration, according to an embodiment of the invention.

Referring now to FIG. 15, there is shown a set of temperature steady-state measurements 1501-1507 of a heating pad corresponding to one or more embodiments of the invention. The measurements 1501-1507 of FIG. 15 are for a heating pad that is in a half blanket condition, wherein the heating pad is laid out with substantially half of the heating pad covered by a blanket. Measurement 1505 is the ambient temperature of approximately 28° C. Measurements 1501-1507 are similar to the measurements of traces 1401-1407, respectively.

Measurement 1506 is the NTC signal used to control the power on and off to the blanket. As in the full blanket configuration, the peaks and troughs of measurement 1506 in the half blanket configuration are substantially synchronous in time with the peaks and troughs of temperature measurements 1501-1505, respectively. The synchronicity indicates that while the NTC signal of measurement 1506 is increasing, indicating that the current flow through the NTC material is increasing, the heating pad temperature is also increasing. A hotter heating pad decreases the resistance of the NTC material and produces a greater electrical current through the NTC material, as would be expected by its negative temperature coefficient. Measurement 1506 recovers more slowly during "on" periods of measurement 1507, compared to the recovery time of measurement 1406 during "on" periods of measurement 1407, because of greater heat loss from uncovered portions of the heating pad.

Measurement 1507 is the power input, having a peak power of approximately 40 watts. Note that measurement 1507 illustrates alternating cycles of approximately two minutes on, followed by one minute off. The "on" cycles are substantially synchronous in time with periods when the NTC current signal is increasing, as indicated by measurement 1506, and periods when the heating pad is heating up as indicated by measurements 1501-1505. As with the full blanket configuration of FIG. 14, an optional power limit may be provided in the heater control, such that the "on" time of measurement 1507 is limited to no more than a predetermined length of time or a predetermined duty cycle.

It should be noted that, as illustrated by FIGS. 14-15, the temperature control method described herein was effective in controlling heating pad temperature, within a desired level of accuracy, for both the full-blanket and half-blanket configurations.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The invention claimed is:

1. A controllable heating pad, comprising:

a heating conductor embedded in the heating pad;

a sensing conductor embedded in the heating pad;

a resistive material providing a distributed electrical path between the heating conductor and the sensing conductor;

a first current sensor to sense a current in the heating conductor, the first current sensor including:

a first current sense resistor having a first terminal forming an input to the first current sensor, and a second terminal, wherein the second terminal of the first current sense resistor is connected to a reference potential;

a diode having a first terminal connected to the first terminal of the first current sense resistor;

a first filter having a first terminal connected to a second terminal of the diode, and a second terminal connected to the second terminal of the first current sense resistor, wherein the first terminal of the first filter forms the first current sensor output; and a second current sensor to sense a current in the sensing conductor.

2. The controllable heating pad of claim 1, wherein the heating conductor comprises a positive temperature coefficient (PTC) material, and the resistive material comprises a negative temperature coefficient (NTC) material.

3. The controllable heating pad of claim 1, wherein the heating conductor, the sensing conductor, and the resistive material are at least partially enclosed within a heat-transmissive sheath.

4. The controllable heating pad of claim 1, further comprising a flexible dielectric material, at least a portion of the dielectric material forming a dielectric core, wherein:

the sensing conductor is wrapped around the dielectric core;

the resistive material forms a sheath around the sensing conductor;

the heating conductor is wrapped around the resistive material; and a heat-transmissive sheath is wrapped around the heating conductor.

5. The controllable heating pad of claim 1, further comprising a flexible dielectric material, at least a portion of the dielectric material forming a dielectric core, wherein:

the heating conductor is wrapped around the dielectric core;

the resistive material forms a sheath around the heating conductor;

the sensing conductor is wrapped around the resistive material; and a heat-transmissive sheath is wrapped around the sensing conductor.

6. The controllable heating pad of claim 4, wherein the flexible dielectric material provides a predetermined amount of stiffness.

7. A controllable heating pad system, comprising:

a heating conductor embedded in the heating pad, the heating conductor formed from a positive temperature coefficient (PTC) material;

a sensing conductor embedded in the heating pad;

a resistive material separating the heating conductor and the sensing conductor, the resistive material providing a distributed electrical path from the heating conductor to the sensing conductor, the resistive material formed from a negative temperature coefficient (NTC) material;

a first current sensor in series with the heating conductor, the first current sensor including:

a first current sense resistor having a first terminal forming an input to the first current sensor, and a second terminal, wherein the second terminal of the first current sense resistor is connected to a reference potential;

a diode having a first terminal connected to the first terminal of the first current sense resistor;

a first filter having a first terminal connected to a second terminal of the diode, and a second terminal connected to the second terminal of the first current sense resistor, wherein the first terminal of the first filter forms the first current sensor output;

a second current sensor in series with the sensing conductor; and a controller to control a current in the heating conductor based on an input from the first current sensor and an input from the second current sensor, wherein the heating conductor, the sensing conductor, and the resistive material are at least partially enclosed within a heat-transmissive sheath.

8. The controllable heating pad system of claim 7, further comprising a switch in series with the heating conductor and the first current sensor, the switch switching between an open state and a closed state based on a control signal from the controller.

9. A method of controlling a temperature of a heating pad, the heating pad having an embedded heating conductor, an embedded sensing conductor, an embedded resistive material that separates the heating conductor and the sensing conductor, and wherein a controllable switch is in series with the embedded heating conductor, the method comprising the steps of warming the heating pad to at least a first predetermined temperature by use of an adjustable on/off signal to the controllable switch;

measuring currents through the embedded heating conductor and the embedded resistive material, the embedded heating conductor being formed from a PTC material, and the embedded resistive material being formed from an NTC material, in order to determine a signal indicative of a temperature of the heating pad; and maintaining a temperature of the heating pad to within a predetermined temperature range by use of the adjustable on/off signal to the controllable switch, wherein the step of warming the heating pad to at least the first predetermined temperature further comprises the steps of resetting the controller to a known state;

setting a target temperature and time limit based on a user input;

starting a timer to record an elapsed time;

exiting a heating mode if a temperature of the NTC material is greater than the first predetermined temperature; and repeating, until a temperature of the PTC material or the temperature of the NTC material is greater than the first predetermined temperature, the steps of:

setting a pulse width modulated cycle to a first ratio of on time to off time if the temperature of the PTC material and the temperature of the NTC material are less than a second threshold;

setting the pulse width modulated cycle to a second ratio of on time to off time if the temperature of the PTC material and the temperature of the NTC material are not less than the second threshold, wherein the second ratio is less than the first ratio; and energizing the heating pad for a time given by the on time of the pulse width modulated cycle;

exiting the heating mode if the elapsed time recorded by the timer is greater than a predetermined limit.

10. The method of claim 9, further comprising the step of monitoring a safety status of the heating pad.

11. The method of claim 10, wherein the step of monitoring a safety status of the heating pad is performed at periodic intervals.

12. The method of claim 10, wherein the step of monitoring a safety status of the heating pad is performed upon interrupt request.

13. The method of claim 10, wherein the step of monitoring a safety status of the heating pad further comprises the step of checking for an over-temperature condition.

14. The method of claim 10, wherein the step of monitoring a safety status of the heating pad further comprises the step of checking for an open circuit condition.

15. The method of claim 9, wherein the adjustable on/off signal is adjustable based upon a difference between a temperature of the heating pad and a second predetermined temperature.

16. The method of claim 9, wherein the step of maintaining a temperature of the heating pad further comprises the steps of:

repeating for a predetermined period of time the steps of disabling power to the heating pad;

waiting until the temperature of the NTC material is less than a target temperature;

setting a pulse width modulated cycle to a first ratio of on time to off time;

repeatedly energizing the heating pad for a time indicated by the pulse width modulated cycle, until a temperature of the PTC material and the temperature of the NTC material is less than the first predetermined temperature;

setting a pulse width modulated cycle to a second ratio of on time to off time, wherein the second ratio is greater than the first ratio;

repeatedly energizing the heating pad for a time indicated by the on time of the pulse width modulated cycle, until the temperature of the PTC material or the temperature of the NTC material is greater than a desired temperature.

17. The method of claim 9, further comprising the step of shutting off the heating pad in response to a predetermined condition.

18. The method of claim 17, further comprising the step of displaying a shutdown status.

19. A circuit to monitor a controllable heating pad, the heating pad having an embedded heating conductor connected to a power source, an embedded sensing conductor connected to the power source, an embedded resistive material that provides a distributed electrical path between the heating conductor and the sensing conductor, and a controllable switch in series with the embedded heating conductor, the circuit comprising:

a first current sensor in series with the embedded heating conductor, the first current sensor connected to the embedded heating conductor at an end of the embedded heating conductor, the first current sensor including:

a first current sense resistor having a first terminal forming an input to the first current sensor, and a second terminal, wherein the second terminal of the first current sense resistor is connected to a reference potential;

a diode having a first terminal connected to the first terminal of the first current sense resistor;

a first filter having a first terminal connected to a second terminal of the diode, and a second terminal connected to the second terminal of the first current sense resistor, wherein the first terminal of the first filter forms the first current sensor output; and a second current sensor in series with the embedded sensing conductor, the second current sensor connected to the embedded sensing conductor at an end of the embedded sensing conductor, wherein a current sensed by the first current sensor is a predetermined function of the temperature of the embedded heating conductor, and a current sensed by the second current sensor is a predetermined function of the temperature of the embedded sensing conductor.

20. The circuit of claim 19, wherein the controllable switch comprises:

a triac in series with the embedded heating conductor, the triac having a first terminal connected to the embedded heating conductor and a second terminal connected to the first current sensor.

21. The circuit of claim 19, wherein the second current sensor further comprises:

a second current sense resistor having a first terminal forming an input to the second current sensor, and a second terminal, wherein the second terminal of the second current sense resistor is connected to a reference potential;

a diode having a positive terminal connected to the first terminal of the second current sense resistor;

a zener diode having a negative terminal connected to a negative terminal of the diode, and a positive terminal connected to the second terminal of the second current sense resistor; and a second filter having a first terminal connected to the negative terminal of the zener diode, and a second terminal connected to the second terminal of the second current sense resistor, wherein the first terminal of the first filter forms the second current sensor output.

22. A circuit to monitor a controllable heating pad, the heating pad having an embedded heating conductor connected to a power source, an embedded sensing conductor, an embedded resistive material that provides a distributed electrical path between the heating conductor and the sensing conductor, and wherein a controllable switch is in series with the embedded heating conductor, the circuit comprising:

a first current sensor in series with the embedded heating conductor, the first current sensor having a first terminal connected to the embedded heating conductor at an end of the embedded heating conductor, and a second terminal connected to a reference potential;

a first resistor having a first terminal connected to a supply voltage, and a second terminal connected to a first end of the embedded resistive material;

an electrical connection from a second end of the embedded sensing conductor to the first terminal of the first current sensor, the second end of the embedded sensing conductor at an opposite end from the first end of the embedded sensing conductor; and a second current sensor having a first terminal connected to the first end of the embedded sensing conductor, and a second terminal connected to the reference potential.

23. The circuit of claim 22, wherein the controllable switch comprises:

a triac in series with the embedded heating conductor, the triac having a first terminal connected to the embedded heating conductor and a second terminal connected to the first current sensor.

24. The circuit of claim 22, wherein the first current sensor further comprises:

a first current sense resistor having a first terminal forming an input to the first current sensor, and a second terminal connected to a reference potential;

a diode having a first terminal connected to the first terminal of the first current sense resistor;

a first filter having a first terminal connected to a second terminal of the diode, and a second terminal connected to the second terminal of the first current sense resistor, wherein the first terminal of the first filter forms the first current sensor output.

25. The circuit of claim 22, wherein the second current sensor further comprises:

a second current sense resistor having a first terminal forming an input to the second current sensor, and a second terminal connected to a reference potential;

a diode having a positive terminal connected to the first terminal of the second current sense resistor;

a zener diode having a negative terminal connected to a negative terminal of the diode, and a positive terminal connected to the second terminal of the second current sense resistor; and a second filter having a first terminal connected to the negative terminal of the zener diode, and a second terminal connected to the second terminal of the second current sense resistor, wherein the first terminal of the first filter forms the second current sensor output.

* * * * *